US010118306B2

(12) United States Patent
Scimone et al.

(10) Patent No.: US 10,118,306 B2
(45) Date of Patent: Nov. 6, 2018

(54) SAFETY CUTTER RING

(71) Applicant: SLICE, INC., San Jose, CA (US)

(72) Inventors: Thomas John Scimone, San Jose, CA (US); Scot Herbst, Santa Cruz, CA (US); Hailey Ann Scimone, San Jose, CA (US); William Whitfield Hunter, Santa Cruz, CA (US); Robert Joseph Gallegos, Fremont, CA (US)

( * ) Notice: Subject to any disclaimer, the term of this patent is extended or adjusted under 35 U.S.C. 154(b) by 0 days.

(21) Appl. No.: 15/450,274

(22) Filed: Mar. 6, 2017

(65) Prior Publication Data

US 2018/0250841 A1 Sep. 6, 2018

(51) Int. Cl.
*B26B 27/00* (2006.01)
*A44C 9/00* (2006.01)

(52) U.S. Cl.
CPC ..... *B26B 27/007* (2013.01); *A44C 9/0061* (2013.01)

(58) Field of Classification Search
CPC .... A44C 9/0053; A44C 9/0061; B26B 27/007
USPC ..... 30/298
See application file for complete search history.

(56) References Cited

U.S. PATENT DOCUMENTS 124,464 A * 3/1872 Waters ..... A01D 46/28 2/21
916,515 A * 3/1909 Willetts ..... B26B 27/007 30/298
1,028,667 A * 6/1912 Billau ..... A47F 13/045 30/298
1,379,864 A * 5/1921 Gregory ..... B26B 27/007 30/291
1,519,816 A * 12/1924 Ward ..... B43M 7/002 30/298
2,380,186 A * 7/1945 Mayer ..... A47L 13/08 131/246
2,572,245 A * 10/1951 Coldiron ..... B26B 27/007 225/56
4,703,561 A * 11/1987 Parisek ..... B26B 27/007 30/298
7,373,728 B2 * 5/2008 Ferman ..... B26B 13/20 30/232
2012/0180324 A1 * 7/2012 Caldwell ..... B26B 27/007 30/298
2014/0259694 A1 * 9/2014 Oldham ..... B26B 27/007 30/298
2014/0373692 A1 * 12/2014 Zeltner ..... B43M 7/002 83/13

FOREIGN PATENT DOCUMENTS

CA 2125721 * 12/1995
FR 1033607 * 7/1953

* cited by examiner

*Primary Examiner* — Hwei C Payer
(74) *Attorney, Agent, or Firm* — James M. Smedley LLC; James Michael Smedley, Esq.

(57) ABSTRACT

The present invention generally relates to a wearable cutting device. Specifically, the present invention relates to a cutting device that can be worn over the finger, so that simply by movement of the finger, cutting action may occur upon contact with a surface.

20 Claims, 2 Drawing Sheets

SAFETY CUTTER RING

FIELD OF INVENTION

The present invention generally relates to a cutting device. Specifically, embodiments of the present invention relate to a finger-operated safety cutter. Embodiments of the safety cutter ring are worn as a convention ring, such that the invention stays firmly secure on the finger while depression and guidance from the finger provides the force and necessary motion to employ the cutting capabilities of the present invention.

BACKGROUND OF THE INVENTION

The basic utility knife is so named because it allows for performing general or utility knifing functions with the added convenience of easy portability. One of the most common places to use a utility knife is a warehouse in shipping and receiving departments, retail/grocery stores, and restaurants/fast food establishments. With the utility knife, workers can cut open packages, cut string or strapping material, and snip adhesive materials (e.g. tape). With all these functions, it is a tremendous bonus to be able to easily transport and store the utility knife so that it is readily available at a moment's need without compromising safety.

However, there are some drawbacks to the basic utility knife. One of the main disadvantages of the basic utility knife is that although technically it requires a single handle for use, in practical applications two hands are required. Whereas one hand operates the utility knife, often the other hand is used to brace the object to be knifed. This bracing is often necessary for two purposes: (i) to ensure that the object does not move during the cutting process and (ii) to ensure mechanical efficiency. When using a utility knife, typically the bracing hand is in close proximity to the cutting hand to approach a task in a balanced body position. Unfortunately, this violates one of the cardinal rules of utility knife safety: keep the body away from the cutting line. Even if the bracing hand is not in close proximity, a distraction or slipping of the hand can easily cut the triggering hand. Thus, although the retractable blade of a utility knife does have significant safety features, the practical use of such a knife nevertheless poses some logistical safety concerns.

Current utility knifes can also be easily misplaced. For example, when taking a brief work break, it is conceivable that the utility knife can be lost among a pile of cardboard, adhesive tape and/or wrapping tape. Another possibility is while an urgent matter springs up, the user in haste attends to the urgent matter without thought to where the knife was last used. The can lead to "borrowing" of the knife, which may ultimately never be returned.

Therefore, there is a need in the art of a basic utility knife that provides basic utility knife functions with diminished concern for bodily harm or displacement of the knife itself. These and other features and advantages of the present invention will be explained and will become obvious to one skilled in the art through the summary of the invention that follows.

SUMMARY OF THE INVENTION

Accordingly, embodiments of the present invention are directed to a safety cutter ring comprising a ring shaped body comprising a blade receiver, wherein the ring shaped body comprises an opening at each a lateral front end and a lateral rear end, wherein the blade receiver is formed on and extends from a bottom edge of said ring shaped body and comprises a cavity formed within walls of the extension of said bottom edge of said ring shaped body, wherein said cavity is configured to retain a blade, and wherein the cavity comprises an aperture within a bottommost wall of the extension from said bottom edge of said ring shaped body to allow for the blade to project outwards away from the ring shaped body.

According to an embodiment of the present invention, the ring shaped body of the safety cutter ring tapers into the blade receiver at both lateral sides, the front end and the rear end.

According to an embodiment of the present invention, the lateral openings of the safety cutter ring are of a different size. Particularly, the front lateral end is of a smaller circumference than the rear lateral end.

According to an embodiment of the present invention, the front and rear later openings of the safety cutter ring are of the same circumference.

According to an embodiment of the present invention, the aperture of the safety cuter ring is located towards a front end of the blade receiver.

According to an embodiment of the present invention, the aperture of the safety cutter ring is transverse along the dorsal side of the blade receiver.

According to an embodiment of the present invention, further comprising of an insert with a cylindrical body with openings at each end to receive a user's finger.

According to an embodiment of the present invention, the insert is removable.

According to an alternative embodiment of the present invention, a safety cutter ring comprises a body comprising of a holding member and a blade receiver member, wherein the holding member has an opening at each a front lateral end and a rear lateral end, and wherein the blade receiver member connects from a bottom wall of said holding member, wherein a cavity configured to retain a blade is formed within the walls of said blade receiver member and wherein said cavity comprises an aperture within a bottommost wall of said blade receiver member to allow for the blade to project outwards, away from the holding member.

According to an alternate embodiment of the present invention, the lateral openings of the safety cutter ring are circular to configure a ring shaped holding member.

According to an alternate embodiment of the present invention, the lateral openings of the safety cutter ring are of a different size. Particularly, the front lateral end is of a smaller circumference than the rear lateral end.

According to an alternate embodiment of the present invention, the front and rear later openings of the safety cutter ring are of the same circumference.

According to an alternate embodiment of the present invention, the aperture of the safety cuter ring is located towards a front end of the blade receiver portion.

According to an alternate embodiment of the present invention, the aperture of the safety cutter ring is transverse along the dorsal side of the blade receiver member.

According to an alternate embodiment of the present invention, the blade receiver member of the safety cutter ring is removable.

According to an alternate embodiment of the present invention, the alternate embodiment further comprises of an insert that fits with the ring shaped cavity that functions to accommodate smaller fingers.

According to an alternate embodiment of the present invention, the insert comprises of a cylindrical body with openings at each end to receive a user's finger.

According to an alternate embodiment of the present invention, the insert of this alternate embodiment is removable.

DETAILED SPECIFICATION

Figure 1:
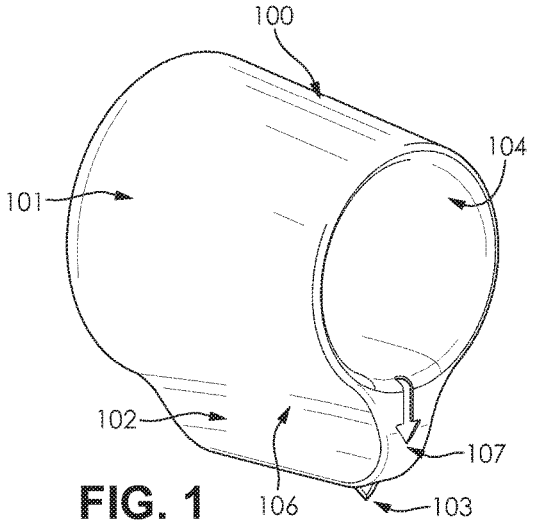
FIG. 1 is a front perspective view of a safety cutter ring with its blade extended in accordance with an embodiment of the present invention.

The present invention generally relates to a cutting device. Specifically, the present invention relates to a general and all-purpose cutting device designed to be worn on the user's finger. Various embodiments of the safety cutter ring include different sizes of openings for the fingers for a more comfortable and secure fit. Other embodiments include an additional insertion that provides a more snug and/or comfortable fit for the finger.

According to an embodiment of the present invention, the safety cutter ring is comprised of essentially three elements: a ring shaped body, a blade receiver, and the blade. Certain embodiments of the present invention may include fewer components or additional components depending on the utilization and purpose for the safety cutter ring.

According to an embodiment of the present invention, the ring shaped body is designed to receive the user's finger. Structurally in the preferred embodiment, it comprises of a tubular configuration with an opening at both the front end and the rear end. These openings allow the safety cutter ring to be worn as if it were a ring.

In alternate embodiments of the present invention, the ring shaped body comprises of an internal component and an external component. The internal component is generally comprised of a hollow, elongated shell. While the preferred embodiment requires the hollow elongated shell to be cylindrical, other embodiments may comprise of some other elongated geometric configuration. Similarly, the external component, while preferentially tubular, can also be adapted to any desired geometrical configuration. When two separate components are utilized in the alternate embodiment, the two components can either be fixed by an adhesion means, for example, an adhesive, or shaped so the internal component fits snuggly within the external component. One of ordinary skill in the art would appreciate that there are many other suitable adhesion means that can be adapted to affix the internal component to the external component.

In the preferred embodiment, the ring shaped body is intended to fit securely over parts of the distal and intermediate phalanges. This preferred positioning provides for optimal use of the present invention. For optimal use, the blade of the present invention should be flush against the cutting surface. Downward pressure from the finger is applied to make meaningful contact between the present invention and the cutting surface. The upper portion of the finger, which includes the distal and intermediate phalanges, has greater dexterity than the lower finger, which includes parts of the intermediate and proximal phalanges, to control the angle of the blade so that the blade can be even with the cutting surface.

In connection with dexterity, the distal phalanges of the upper finger portion support use of the present invention by better receiving sensory information than the lower finger portion. This sensitivity to sensory information is useful for guiding the present invention through use since the blade of the present invention is not in view during operation. Accordingly, the user must be able to sense the location of the blade and be able to gauge how much pressure is necessary to depress the present invention to enable cutting/slicing of the desired surface. The upper finger portion is more suitable for this task by comprising of apical tufts which support fibrofatty pads that deform to accommodate various types of surfaces. In detail, these tufts detect deformation by tactile sensory receptors that respond to various stimuli such as the weight of the blade and the palpable sensation of the blade touching the cutting surface.

In order to achieve the preferred embodiment, the openings at the front lateral end and the rear lateral end are shaped in a circular fashion. For the preferred embodiment, the front lateral end has a smaller circumference than the rear lateral end. This will enable the present invention to slide easily over the finger, but still remain firm and secure without concern for sliding. However, users may have their own preferences or needs. Accordingly, alternate embodiments include a front lateral opening to be of the same size as the rear lateral opening. One of ordinary skill in the art would appreciate that there are many other suitable sizes and shapes of the openings and tubular body, and any combination of sizes and shapes thereof of the present invention can be adapted to accommodate the different sizes, fits, and comfortability preferences of the user.

According to embodiments of the present invention, the blade receiver forms on and extends from the bottom edge of the ring shaped body. According to the preferred embodiment of the present invention, the ring shaped body tapers into the blade receiver at the lateral sides as well as the front end and the rear end. These tapering configurations serve important roles in the use of the present invention. Firstly, as mentioned above, the blade is not visible during the intended use of the invention. Accordingly, the lateral tapering concentrates the area that receives the downward pressure force from depression of the finger. This permits the user to better sense the blade in order to decipher how much pressure is necessary for cutting a surface. Secondly, the lateral tapering assists with greater ability to balance the present invention. By localizing weight distribution, the center of gravity in shifted toward the tapered region directly above the blade with the result that less maintenance is required for balancing. Thirdly, the front and rear tapering configuration serves as a convenient guiding structure. As mentioned previously, tapering has the effect of concentrating weight. Since the front end and the rear end are mostly hollow, the tapering at the front and rear ends adds weight to these regions making it easier to glide the present invention along a cutting surface. In the preferred embodiments, the degree of tapering at the front end of the claimed invention is equal or similar to the degree of tapering occurring at the rear rend. In alternate embodiments, the degree of tapering between the front end and the rear end may differ to provide appropriate comfort and ease for use.

The blade receiver comprises of at least two significant features: (i) a cavity and (ii) an aperture. The cavity serves to hold the blade. In connection, the aperture within the cavity permits the blade to be projected out from the cavity so it may make contact with a cutting surface. The blade can be affixed within the cavity in any convenient and suitable position as appropriate for the type of blade used. As illustrations (but not to serve as a limitation of the present invention), if the blade to be used where a fixed, single bevel blade, then it may be affixed within the cavity at angle sufficient for the cutting edge to meet the cutting surface. One of ordinary skill in the art would appreciate that a blade may be configured within the cavity in various orientations depending on the type of blade utilized for a particular embodiment.

In the preferred embodiment, the aperture is situated only towards the front end. Having a small localized area from which the blade projects contributes to the safety features of the present invention since it minimizes the surface area of a cutting surface. However, alternative embodiments may include an aperture that traverses the length of the blade receiver, so that a longer cutting edge can be employed. Further, the dimensions of the aperture may vary depending on the type of blade used. For example, a ceramic blade, which is typically a thicker blade, may require a wider aperture than a steel blade. One of ordinary skill in the art would appreciate that the aperture may be configured for any size suitable for housing a blade.

In an alternative embodiment, the present invention is comprised of a body consisting of a holding member and an affixed blade receiver member. In this embodiment, the holding member does not taper into the blade receiver member; instead the holding member is a separate attached to the blade receiver member. The holding member has a tubular configuration and an opening at each a front end and a rear end. The blade receiver member comprises of a rectangular configuration, further comprising of (i) a cavity that retains the blade and (ii) an aperture within the cavity from which the blade project outwards towards the cutting area. As with the preferred embodiment, the holding member may also have front, rear, and/or lateral sides that taper towards the dorsal (bottom) end.

In an embodiment of the claimed invention, the holding member is affixed to the blade receiver member by use of an adhesive means such as glue or other types of fasteners. However, embodiments of the present invention also include using engineering (e.g. joinery) techniques to adhere pieces together without the use of adhesives. As an illustrative example (and not intended to serve as a limitation), the holding member may be joined to the blade receiver member by means of creating a dado joint such that an indent in the blade receiver member is capable of receiving a piece from the holding member. In some embodiments, the blade receiver member is removable to enable replacement of blade. One of ordinary skill in the art would appreciate that there are numerous ways to join the holding member to the blade receiver member, and embodiments of the present invention are contemplated to employ any such techniques and methodologies for joining pieces.

Further embodiments of the present invention include iterations where there are two or more ring shaped bodies to permit additional fingers to be received. For example, an embodiment may include a holding member with three openings (for each the index finger, the middle finger, and the ring finger). Similarly, an embodiment may include three ring shaped bodies connected to each other so that a user is able to receive sturdier support to control the movement of the blade receiver portion (or blade receiver member).

It is envisioned that the claimed invention can utilize any type of blade without restrictions on type of blade edge or the material to be used. Types of blade edge include a standard box cutter blade and a utility blade. Such blades may have any variety of tips, including rounded tips to reduce the chance of injury, V (flat) tip, asymmetrical semi convex, asymmetrical V (flat), compound (double) bevel, chisel, chisel with back bevel, and chisel with urasuki geometry. As is evident in the non-limiting list of potential blade types, embodiments of the present invention include blades that have more than one cutting edge. Accordingly, this will enable the present invention to cut a surface in both the forward-moving and rear-moving direction. Further, the blade can be made from any suitable material, including, but not limited to metal, ceramic, tempered steel, stainless steel, high carbon steel, titanium, diamond, and obsidian. One of ordinary skill in the art would appreciate that there are numerous configurations and materials that might be used for the blade, and embodiments of the present invention are contemplated for use with any material or configuration.

In alternate embodiments, the claimed invention further comprises of a removable insert that can accommodate smaller fingers. The insert itself is comprised of a cylindrical body with openings at each end. When there is a user with smaller fingers (such as younger child), the insert can slide within the ring shaped body yielding an all-around cushioning for inserted finger for a more comfortable fit. In the preferred embodiment, the insert is comprised of silicone.

Turning now to FIG. 1, a perspective view of the safety cutter ring, in accordance with an embodiment of the present invention illustrating the front face of the present invention. In the preferred embodiment, the safety cutter ring 100 is comprised of a ring shaped body 101, a blade receiver 102, and a blade 103 projecting from a cavity (not shown) within blade receiver through an aperture (not shown). The ring shaped body 101 comprises of an opening at a front end 104 (of the ring shaped body) and a rear end (not shown). This embodiment illustrates the tapering configuration from the ring shaped body to the blade receiver at the end 108 (of the blade receiver) and the front end 107 (of the blade receiver).

Figure 2:
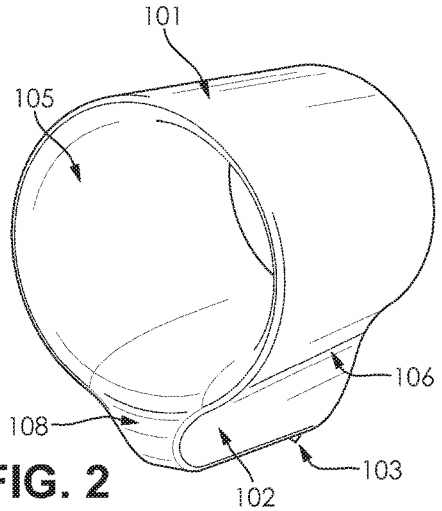
FIG. 2 is a rear perspective view of a safety cutter ring with its blade extended in accordance with an embodiment of the present invention.

Turning now to FIG. 2, a perspective view of the safety cutter ring in accordance with an embodiment of the present invention illustrating the rear face of the present invention. In the preferred embodiment, the safety cutter ring 100 has an opening at the rear end 105 (of the ring shaped body) which is bigger than the opening at the front end (of the ring shaped body). Due to the differences in sizes between the front end (of the ring shaped body) and the rear end (of the ring shaped body) in the presented embodiment, the degree of tapering at the front end (of the blade receiver) differs from the degree of tapering at the rear end 108 (of the blade receiver). In detail the tapering at the front end (of the blade receiver) is longer in distance and narrower than the tapering at the rear end 108 (of the blade receiver). However, in alternate embodiments where the openings at the front end 104 (of the ring shaped body) and rear end 105 (of the ring shaped body) are of the same size, the tapering at the front end 107 (of the blade receiver) is identical to the tapering at the rear end 108 (of the blade receiver).

Figure 3:
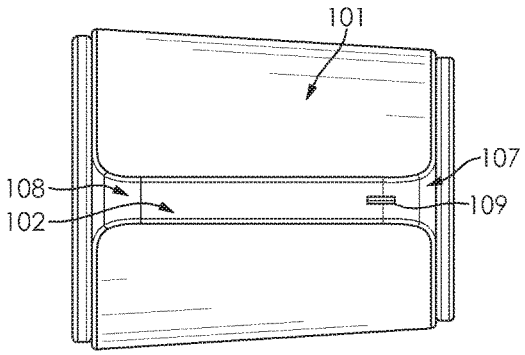
FIG. 3 is a bottom/dorsal perspective view of a safety cutter ring with its blade extended in accordance with an alternate embodiment of the present invention.
Figure 4:
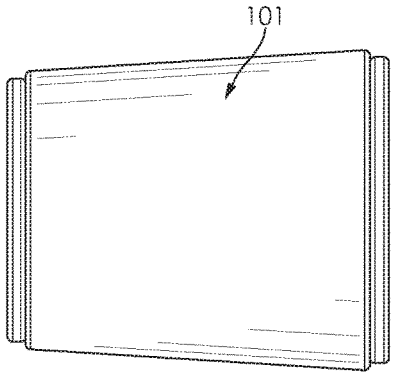
FIG. 4 is a top perspective view of a safety cutter ring in accordance with an alternate embodiment of the present invention.

Turning now to FIG. 3, and FIG. 4, perspective views of the safety cutter ring in accordance with an embodiment of the present invention respectively illustrating a bottom face, and a top face of the present invention. The underside view of FIG. 3 illustrates an aperture 109 from which the blade protrudes.

Figure 5:
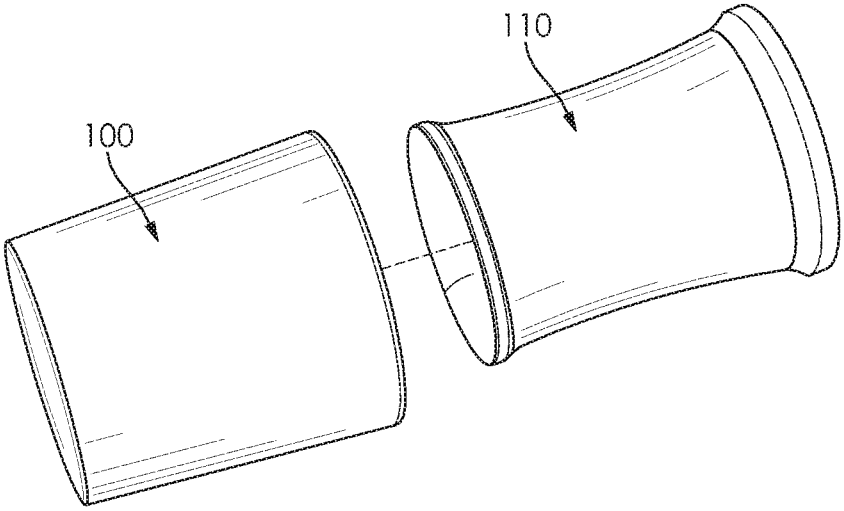
FIG. 5 is a top perspective view of a safety cutter ring in accordance with an alternate embodiment of the present invention.

Turning now to FIG. 5, a perspective view of the safety cutter ring in accordance with an embodiment of the present invention with an insert 110.

Figure 6:
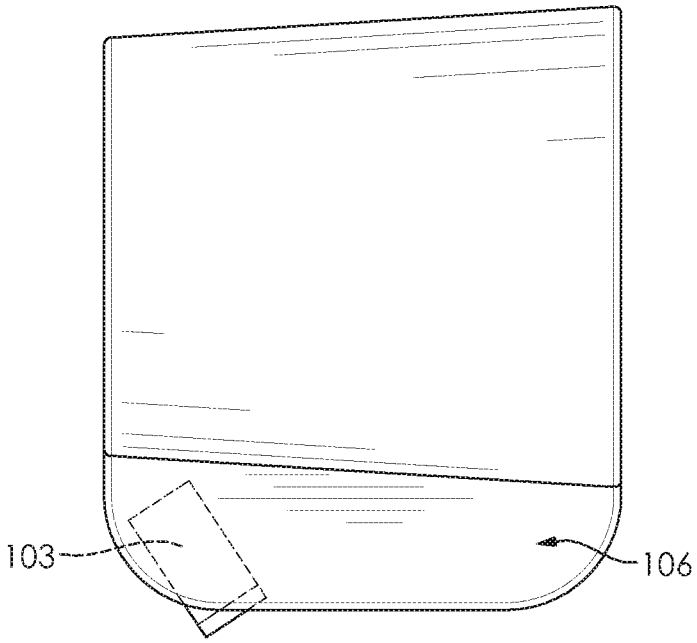
FIG. 6 is a is cross-sectional view of a safety cutter ring with its blade extended in accordance with an embodiment of the present invention.

FIG. 6 is a vertical cross sectional view of an embodiment of the present invention without an insert. It shows a cavity 106 retaining a blade 103 extending through an aperture (not shown) to make contact with a cutting surface.

It should be noted that features illustrated in the drawings are not necessarily drawn to scale, and features of one embodiment may be employed with other embodiments as the skilled artisan would recognize, even if not explicitly stated herein.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

What is claimed is:

1. A safety cutter ring comprising:
a blade,
a ring shaped body and a blade receiver,
wherein said ring shaped boy includes an opening at each of a front end and a rear end,
wherein the blade receiver is formed on and extends from a bottom side of said ring shaped body and comprises:
a cavity formed within walls of the blade receiver extending from said bottom side of said ring shaped body, wherein said cavity is configured to retain the blade,
wherein said cavity includes an aperture within a bottommost wall of the blade receiver extending from said bottom side of said ring shaped body to allow for the blade to project outwards, away from the ring shaped body,
wherein more than three-quarters of the blade is retained within the cavity,
wherein the blade is fixed at an angle relative to the bottom side of said ring shaped body, and
wherein a portion of the blade projecting outwardly from the cavity is triangular portion.

2. The safety cutter ring of claim 1, wherein the ring shaped body tapers into the blade receiver at both sides of said ring shaped body, the front end, and the rear end.

3. The safety cutter ring of claim 2, wherein the front end is of a smaller circumference than the rear end.

4. The safety cutter ring of claim 3, wherein the aperture is located towards a front end of the blade receiver.

5. The safety cutter ring of claim 1, further comprising of an insert that fits within a ring shaped cavity of said ring shaped body to accommodate smaller fingers, the insert having a cylindrical body with openings at each end to receive a user's finger.

6. The safety cutter ring of claim 1, wherein the triangular portion is less than one-quarter of the blade.

7. The safety cutter ring of claim 1, wherein the blade is formed from ceramic material.

8. A safety cutter ring comprising:
a blade,
a ring shaped body and a blade receiver,
wherein said ring shaped boy includes an opening at each of a front end and a rear end,
wherein the blade receiver is formed on and extends from a bottom side of said ring shaped body and comprises:
a cavity formed within walls of the blade receiver extending from said bottom side of said ring shaped body, wherein said cavity is configured to retain the blade,
wherein said cavity includes an aperture within a bottommost wall of the blade receiver extending from said bottom side of said ring shaped body to allow for the blade to project outwards, away from the ring shaped body,
wherein more than three-quarters of the blade is retained within the cavity,
wherein the blade is fixed at an angle relative to the bottom side of said ring shaped body, and
wherein the blade is disposed at the front end and is angled toward the rear end, the front end having a smaller circumference than the rear end.

9. The safety cutter ring of claim 8, wherein the ring shaped body tapered into the blade receiver at both sides of said ring shaped body, the front end, and the rear end.

10. The safety cutter ring of claim 9, wherein the front end is of a smaller circumference than the rear end.

11. The safety cutter ring of claim 10, wherein the aperture is located towards a front end of the blade receiver.

12. The safety cutter ring of claim 8, further comprising of an insert that fits within a ring shaped cavity of said ring shaped body to accommodate smaller fingers, the insert having a cylindrical body with an opening at each end to receive a user's finger.

13. The safety cutter ring of claim 8, wherein the blade is formed from ceramic material.

14. A safety cutter ring comprising:
a blade,
a body including a holding member and a blade receiver member, and
an insert member that is removably disposable in the holding member,
wherein the holding member has an opening at each of a front end and a rear end,
wherein the blade receiver member extends from a bottom wall of said holding member,
wherein a cavity configured to retain the blade is formed within walls of said blade receiver member,
wherein said cavity comprises an aperture within a bottommost wall of said blade receiver member to allow for the blade to project outwards, away from the holding member,
wherein the front end is of a smaller circumference than the rear end,
wherein the blade is angled toward the rear end,
wherein the insert member has a length that is greater than a length of the holding member,
wherein the insert member fits within a ring shaped cavity of the holding member, and
wherein the insert member has an inward-curving middle portion and includes a protrusion disposed on at least one end portion of the insert member.

15. The safety cutter ring of claim 14, wherein the insert member is formed from a silicone material.

16. The safety cutter ring of claim 14, wherein the aperture is situated towards a front end of the blade receiver member.

17. The safety cutter ring of claim 14, wherein the insert member is formed from a cushioning material.

18. The safety cutter ring of claim 14, wherein the insert member has a cylindrical body with openings at each end to receive a user's finger.

19. A cutting device comprising:

a hollow body;

an insert member that is removably disposable in the hollow body;

a blade receiver; and a blade;

wherein the hollow body includes an opening at a front end and an opening at a rear end;

wherein the blade receiver is formed on and extends from the hollow body;

wherein a cavity is formed within walls of the blade receiver extending from the hollow body, wherein the cavity is configured to retain the blade;

wherein the blade projects outwards away from the hollow body through an aperture of the cavity;

wherein the front end is of a smaller circumference than the rear end;

wherein the blade is formed from ceramic material;

wherein more than three-quarters of the blade is retained within the cavity;

wherein the insert member has a length that is greater than a length of the hollow body; and wherein the blade is disposed at a front end of the blade receiver and angled toward a rear end of the blade receiver.

20. A cutting device comprising:

a hollow body;

an insert member that is removably disposable in the hollow body;

a blade receiver; and a blade;

wherein the hollow body includes an opening at a front end and an opening at a rear end;

wherein the blade receiver is formed on and extends from the hollow body;

wherein a cavity is formed within walls of the blade receiver extending from the hollow body, wherein the cavity is configured to retain the blade;

wherein the blade projects outwards away from the hollow body through an aperture of the cavity;

wherein the front end is of a smaller circumference than the rear end;

wherein the blade is formed from ceramic material;

wherein more than three-quarters of the blade is retained within the cavity;

wherein the insert member has a length that is greater than a length of the hollow body; and wherein a portion of the blade projecting outwardly from the cavity is a triangular portion.

* * * * *